US006332851B1

(12) United States Patent
Griffin

(10) Patent No.: US 6,332,851 B1
(45) Date of Patent: Dec. 25, 2001

(54) TOY CONKER

(76) Inventor: Simon Richard Griffin, 320 Queens Esplanade, Birkdale Queensland 4159 (AU)

( * ) Notice: Subject to any disclaimer, the term of this patent is extended or adjusted under 35 U.S.C. 154(b) by 0 days.

(21) Appl. No.: 09/486,714

(22) PCT Filed: Apr. 23, 1999

(86) PCT No.: PCT/AU98/00643

§ 371 Date: Mar. 8, 2000

§ 102(e) Date: Mar. 8, 2000

(87) PCT Pub. No.: WO99/12613

PCT Pub. Date: Mar. 18, 1999

(30) Foreign Application Priority Data

Sep. 9, 1997 (GB) ..... 9719079
Jan. 7, 1998 (AU) ..... PP1243

(51) Int. Cl.[7] ..... A63B 67/10; A63H 33/18

(52) U.S. Cl. ..... 473/577; 273/440; 473/576; 473/594; 473/575; 446/4; 446/69; 446/490

(58) Field of Search ..... 273/359, 383, 273/380, 331, 157 R, 317.8, 329, 330, 334, 338; 473/576, 577, 594, FOR 134, FOR 160, FOR 163, 575, 424–430; 446/4, 5, 69, 490, 247

(56) References Cited

U.S. PATENT DOCUMENTS

| | | | | |
|---|---|---|---|---|
| 1,258,464 | * | 3/1918 | Riley | 446/69 |
| 1,513,773 | * | 11/1924 | Thompson | 473/576 |
| 2,308,524 | * | 1/1943 | Longnecker | 446/6 |
| 3,139,697 | * | 7/1964 | Mier | 446/4 |
| 3,687,452 | * | 8/1972 | Thompson | 473/577 |
| 4,886,273 | | 12/1989 | Unger . | |
| 5,165,689 | * | 11/1992 | Forsse et al. | 273/157 R |

FOREIGN PATENT DOCUMENTS

| | | |
|---|---|---|
| 2143142A | 6/1985 | (GB) . |
| 2317579A | 1/1998 | (GB) . |

* cited by examiner

*Primary Examiner*—Raleigh W. Chiu
(74) *Attorney, Agent, or Firm*—Hoffman, Wasson & Gitler, PC

(57) ABSTRACT

A toy conker which has a main body portion attachable to a line member, the body portion having at least one insert which can be struck off.

7 Claims, 2 Drawing Sheets

TOY CONKER

FIELD OF THE INVENTION

This invention relates to a toy, and particularly relates to a toy which is similar to a game called "conkers".

BACKGROUND ART

The game of conkers has traditionally been played using the fruit of the horse chestnut tree. Two players would each thread the nut from a horse chestnut tree (conker) onto a length of string. Both players would each take turns in striking their opponents conker until one of the conkers was broken from its string. The player with the conker left intact at the end of the game was declared the winner.

On disadvantage with using nuts from the chestnut tree was that the nuts are no always readily available. Also, the game requires one of the nuts to be cracked or broken and thus the nuts were not reusable. Another disadvantage with the use of nuts is the difficulty with quarantine restrictions in many countries with respect to passage of fruit and nut produce.

OBJECT OF THE INVENTION

The present invention is directed to a toy which can be played in a manner similar to that of conkers, but where the toy has at least one, and preferably a plurality of segments which can be struck from the main body of the toy and which can be refitted to allow the conker to be reused many times.

It is an object of the present invention to provide a toy which may provide advantages over the traditional game of conkers, or which may provide the consumer with a useful or commercial choice.

In one form, the invention resides in a toy which has a main body portion which is attachable relative to a line member, and at least one segment which can be struck from the main body portion.

The main body portion may resemble the shape of a traditional conker, and therefore may be substantially spherical. However, it should be appreciated that the main body portion can have a number of different shapes such as part spherical, oval, cuboid, or other curved and/or polygonal shapes.

The size of the main body portion can vary to suit. Again, to resemble a traditional conker, the main body portion may have a cross section size of between 1 to 5 cm.

The main body portion can be attached to the line member by providing a bore through the main body portion through which the line member can pass. The line member can be knotted to hold the main body portion to the line member. Of course, other types of attachments are also envisaged.

The at least one segment is preferably reattachable to the main body portion after it has been struck off. This allows the toy to be reused many times. In another form, the segment can be partially dislodged or moved sufficiently to indicate a "hit", while still being attached in some form to the main body portion.

The at least one segment is preferably made from a suitably strong material such that it is not damaged when struck from the main body portion. In one form, the at least one segment can be made from suitable plastics material.

It is preferred that the toy has a plurality of said segments and preferably that from 1 to 5 segments are provided. These can be equally or non-equally spaced about the main body portion. As conkers are usually struck on an upper portion, the said segments are usually positioned on an upper portion of the main body portion. However, it is envisaged that one or more segments can be provided on a lower portion of the main body portion. For instance, to allow the toy to be used upside down.

The size of the segments relative to the main body portion can vary, as can the shape of the segments. It is preferred that the size and the shape of each segment is such that it can be struck from the main body portion without excessive difficulty, otherwise the game could quickly lose its appeal. Suitably, the segments comprise about half of the area of the upper portion of the main body portion.

The main body portion may be provided with one or more recesses which can accommodate the one or more segments. It is preferred that the segments have an outer face which is substantially flush with the outside of the main body portion as this can have a bearing on the appeal of the game.

The at least one segment is preferably replaceable such that the top can be reused many times. In one form, the segment is provided with an engagement means which is releasably engageable with the main body portion. In a preferred form, the at least one segment can be releasably clipped into the recesses in the main body portion. It should be appreciated that other types of engagement means are also envisaged.

BRIEF DESCRIPTION OF THE DRAWINGS

An embodiment of the invention will be described with reference to the following drawings in which.

BEST MODE

Figure 1:
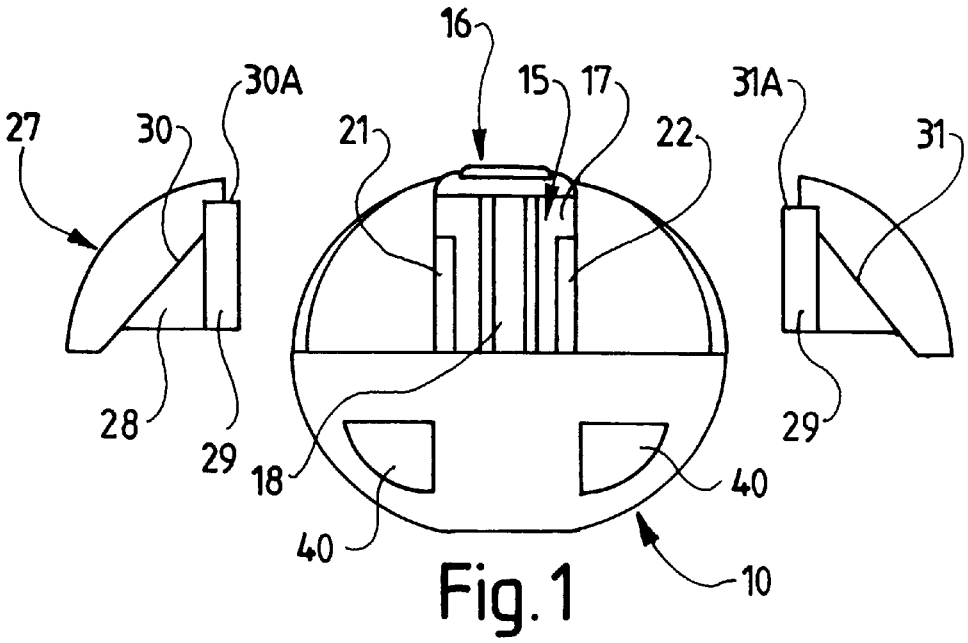
FIG. 1 is a side view of a toy according to an embodiment of the invention with the segments removed from the main body portion.
Figure 2:
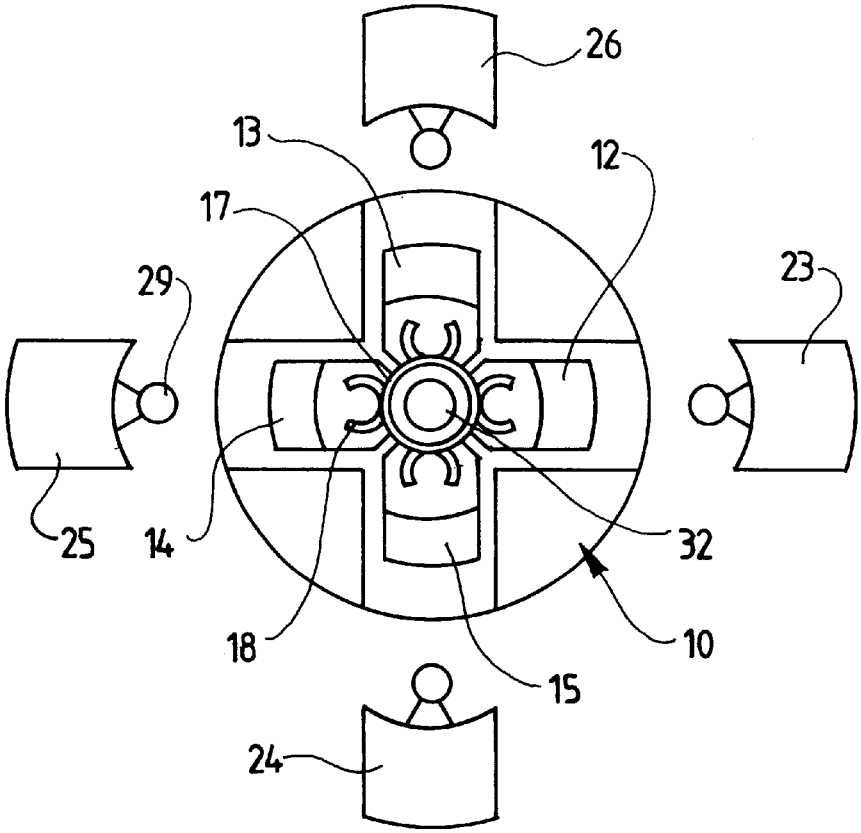
FIG. 2 shows a plan view of the toy with four segments being removed from the main body portion.
Figure 3:
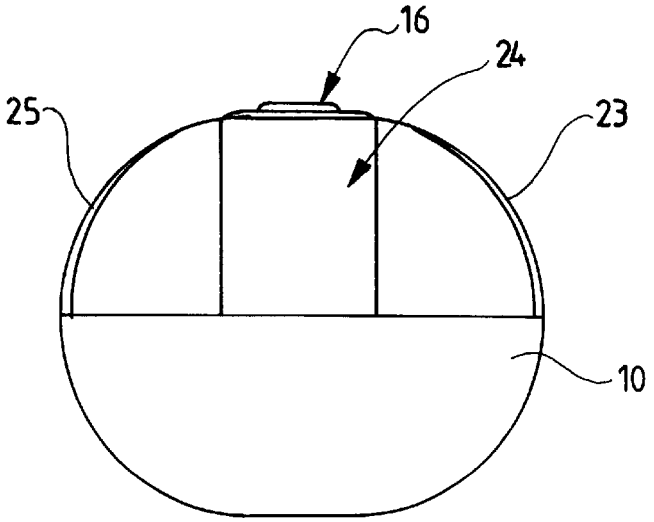
FIG. 3 is a side view of the toy of FIG. 1 with the segments attached to the main body portion.

Referring to the drawings, and initially to FIG. 1, there is illustrated a toy conker which has a main body portion 10 formed from plastic and which is more or less spherical in shape. Main body portion 10, in the embodiment, has a diameter of about 3 to 4 cm, but this is preferred only.

Main body portion 10 has an upper half 11. Upper half 11 is provided with four recesses 12–15 which are equally spaced about upper half 11. Each recess is substantially rectangular and extends from a mid-portion of the main body portion 10 to an upper central ring 16. Each recess 12–15 has a back wall 17 which supports a vertically extending longitudinal clip 18. Each recess 12–15 has opposed parallel side walls 19, 20. Each said side wall is provided with an inwardly extending downwardly sloping ramp 21, 22 which has an angle of about 45°. The function of ramps 21, 22 will be described in greater detail below.

Each recess 12–15 accommodates a respective segment 23–26. Each segment is formed from plastic which is sufficiently robust to survive being struck from the main body portion 10 several times without damage. Each segment 23–26 has an outer curved body 27. The curvature of body 27 is substantially the same as the curvature of the outer wall of main body portion 10, which provides a substantially flush look to the toy.

Each segment 23–26 has an inwardly extending projection 28 which comprises a terminal longitudinal bead 29, the bead 29 being sized to press fit into clip 18 which is on the back wall of the recess.

Each segment 23–26 has a pair of surfaces 30, 31 which abut against or are closely spaced from ramps 21, 22 in each recess 12 -15. The upper area of each surface 30, 31 has a notched portion 30A, 31A.

In use, the segments 23–26 are clipped into each recess 12–15. The segments are held in place by engagement of bead 29 into clip 18. If the upper portion of the segments are struck with sufficient force by another conker, the segments will become dislodged from the recesses. By striking an upper part of a segment, the segment initially is pushed down onto ramps 21, 22. This acts as a pivot to remove bead 29 from clip 18 which causes the segment to be struck from the main body portion 10.

A central ring 16 is provided on top of the main body portion 10 and this can assist to locate each segment in place.

Figure 4:
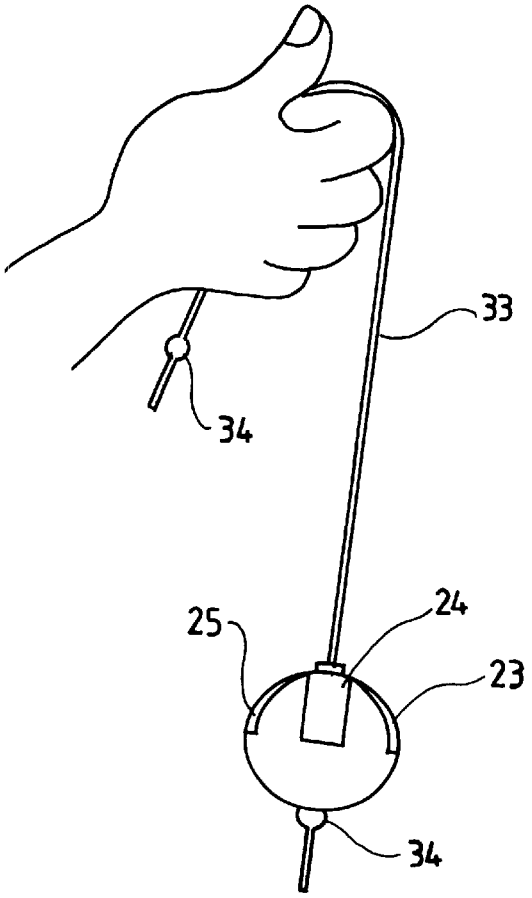
FIG. 4 shows the toy attached to a string and ready for playing.

Main body portion 10 is provided with a central bore 32 through which a flexible line member 33 can pass to hold the toy in place. Member 33 can be knotted (see 34 in FIG. 4) to provide an abutment for the toy.

The lower portion of the body has a number of weight reducing voids 40.

The game is played by holding the toy by line member 33 and attempting to hit another person's toy to remove all of the other persons segments.

It should be appreciated that various other changes and modifications can be made to the embodiment described without departing from the spirit and scope of the invention.

What is claimed is:

1. A toy conker which has a main body portion attachable to a line member, the body portion having at least one insert which can be struck entirely off the main body portion, the insert can be refitted to the main body portion after being struck off, the main body portion has at least one recess in which the at least one insert can locate, the recess having a vertically extending clip and the insert having a rearwardly extending rib which press fits into the clip.

2. The conker of claim 1, wherein the insert is press fitted into the recess.

3. The conker of claim 1, wherein the insert has an outer face which is substantially flush with the surrounding outer surface of the body portion.

4. The conker of claim 1, wherein the at least one insert is on an upper portion of the main body portion.

5. The conker of claim 4, wherein a lower portion of the main body portion has at least one weight-reducing void.

6. The conker of claim 1, wherein the recess has opposed side walls, each side wall having an inwardly extending downwardly sloping ramp along which the insert can ride.

7. A conker having a substantially spherical body, a plurality of inserts spaced about an upper half of the body, each insert being removably fitted into a corresponding recess and able to be removed from the recess by being struck with sufficient force by another conker, the removed inserts being refittable into the corresponding recess.

* * * * *